US009096361B2

(12) United States Patent
Thomas et al.

(10) Patent No.: US 9,096,361 B2
(45) Date of Patent: Aug. 4, 2015

(54) PRODUCT DISPENSING CONTAINER, SYSTEM AND METHOD WITH PRIMING AREA

(71) Applicant: MeadWestvaco Corporation, Richmond, VA (US)

(72) Inventors: Laurel Thomas, Portland, OR (US); Aaron L. Bates, Moseley, VA (US); John Gelardi, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 14/147,819

(22) Filed: Jan. 6, 2014

(65) Prior Publication Data

US 2014/0102942 A1 Apr. 17, 2014

Related U.S. Application Data

(60) Division of application No. 13/039,688, filed on Mar. 3, 2011, now Pat. No. 8,628,003, which is a continuation-in-part of application No. 12/890,631, filed on Sep. 25, 2010, now Pat. No. 8,322,543.

(51) Int. Cl.

| | |
|---|---|
| ***B65D 71/36*** | (2006.01) |
| ***B65D 83/00*** | (2006.01) |
| ***A47F 1/08*** | (2006.01) |

(52) U.S. Cl.

CPC . *B65D 83/00* (2013.01); *A47F 1/08* (2013.01); *A47F 1/087* (2013.01); *B65D 71/36* (2013.01); *B65D 2571/0066* (2013.01); *B65D 2571/00141* (2013.01); *B65D 2571/00339* (2013.01); *B65D 2571/00567* (2013.01); *B65D 2571/00574* (2013.01); *B65D 2571/00728* (2013.01); *B65D 2571/00833* (2013.01)

(58) Field of Classification Search

CPC ..... B65D 71/36; B65D 83/00; B65D 2571/0066; B65D 2571/00574; B65D 2571/00567; B65D 271/00728; A47F 1/08; A47F 1/087

See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Adoniram |

(Continued)

FOREIGN PATENT DOCUMENTS

| | | | |
|---|---|---|---|
| AT | 6036 | U1 | 3/2003 |
| DE | 2655496 | A1 | 6/1978 |

(Continued)

OTHER PUBLICATIONS

International Search Report and Written Opinion for PCT/US2010/057020, Mar. 8, 2011.

(Continued)

*Primary Examiner* — Gary Elkins

(74) *Attorney, Agent, or Firm* — MeadWestvaco Intellectual Property Group

(57) ABSTRACT

A product dispensing container including a plurality of walls that define an internal volume, at least one of the walls including an access door panel, a priming area and a severance line, and a plurality of products received in the internal volume, wherein the priming area is displaceable relative to the wall to form a free edge, and wherein the access door panel is at least partially defined by the free edge and the severance line when the priming area is displaced relative to the wall.

12 Claims, 12 Drawing Sheets

(56) References Cited

U.S. PATENT DOCUMENTS

| | | | |
|---|---|---|---|
| 1,383,318 | A | 7/1921 | Mccormick |
| 1,393,964 | A | 10/1921 | Grover |
| 1,753,957 | A | 4/1930 | Chaffin |
| 1,824,937 | A | 9/1931 | Trouth |
| 1,858,199 | A | 5/1932 | DeMaziroff |
| 1,898,056 | A | 2/1933 | Johnson |
| 1,919,907 | A | 7/1933 | Robinson |
| 1,932,225 | A | 10/1933 | Minter |
| 1,941,458 | A | 1/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |
| 2,291,187 | A | 7/1942 | Johnson |
| 2,382,191 | A | 8/1945 | Weichselbaum |
| 2,536,421 | A | 1/1951 | Burhans |
| 2,573,381 | A | 10/1951 | Arnold |
| 2,574,087 | A | 11/1951 | Burhans |
| 2,595,122 | A | 4/1952 | Burhans |
| 2,732,619 | A | 1/1956 | Labine |
| 2,784,871 | A | 3/1957 | Gabrielsen |
| 2,795,845 | A | 6/1957 | Shimer |
| 2,818,978 | A | 1/1958 | Post |
| 2,826,471 | A | 3/1958 | Fonda |
| 2,831,591 | A | 4/1958 | Morton |
| 2,888,145 | A | 5/1959 | Heselov |
| 2,915,162 | A | 12/1959 | Umstead |
| 2,915,932 | A | 12/1959 | Gross |
| 2,919,488 | A | 1/1960 | Brownlee |
| 2,996,344 | A | 8/1961 | Garman |
| 3,018,149 | A | 1/1962 | Parker |
| 3,055,293 | A | 9/1962 | Lariccia |
| 3,066,827 | A | 12/1962 | Pryor |
| 3,110,434 | A | 11/1963 | Linda |
| 3,137,068 | A | 6/1964 | Quigley |
| D198,888 | S | 8/1964 | Heselov |
| 3,178,242 | A | 4/1965 | Ellis |
| 3,184,104 | A | 5/1965 | Davis |
| 3,203,554 | A | 8/1965 | Pendergrast |
| 3,204,335 | A | 9/1965 | Hughes |
| 3,288,544 | A | 11/1966 | Knecht |
| 3,300,115 | A | 1/1967 | Schauer |
| 3,304,141 | A | 2/1967 | Rogers |
| 3,306,688 | A | 2/1967 | DiDomenico |
| 3,318,455 | A | 5/1967 | Takahashi |
| 3,335,940 | A | 8/1967 | Dykes |
| 3,340,790 | A | 9/1967 | Simjian |
| 3,348,738 | A | 10/1967 | Hertlein |
| 3,392,901 | A | 7/1968 | Krzyzanowski |
| 3,393,808 | A | 7/1968 | Chirchill |
| 3,501,016 | A | 3/1970 | Eaton |
| 3,533,549 | A | 10/1970 | Gilchrist |
| 3,763,557 | A | 10/1973 | Sewell |
| 3,784,022 | A | 1/1974 | Beesley |
| 3,922,778 | A | 12/1975 | Aalpoel |
| 3,923,159 | A | 12/1975 | Taylor et al. |
| 3,954,220 | A | 5/1976 | Foster |
| 3,972,454 | A | 8/1976 | Croley |
| 4,105,126 | A | 8/1978 | Deffner et al. |
| 4,205,440 | A | 6/1980 | Morgan |
| 4,260,072 | A | 4/1981 | Quasarano |
| 4,318,458 | A | 3/1982 | Ritsema |
| 4,382,526 | A | 5/1983 | Stone |
| 4,396,143 | A | 8/1983 | Killy |
| 4,435,026 | A | 3/1984 | Johnson |
| 4,467,524 | A | 8/1984 | Ruff et al. |
| 4,576,272 | A | 3/1986 | Morgan et al. |
| 4,598,828 | A | 7/1986 | Young et al. |
| 4,729,480 | A | 3/1988 | Groover et al. |
| 4,735,315 | A | 4/1988 | Oliff et al. |
| 4,744,489 | A | 5/1988 | Binder et al. |
| 4,834,263 | A | 5/1989 | Becze |
| 4,869,395 | A | 9/1989 | Rubbmark |
| 4,911,309 | A | 3/1990 | Stefan |
| 4,915,571 | A | 4/1990 | Toshihiko et al. |
| 4,923,070 | A | 5/1990 | Jackle et al. |
| 4,997,106 | A | 3/1991 | Rockola |
| 4,998,628 | A | 3/1991 | Ross |
| 5,033,348 | A | 7/1991 | Walsh |
| 5,080,256 | A | 1/1992 | Rockola |
| 5,101,642 | A | 4/1992 | Alexandrov |
| 5,101,703 | A | 4/1992 | Tanaka et al. |
| 5,167,345 | A | 12/1992 | Bleeker |
| 5,190,155 | A | 3/1993 | Grunwald |
| 5,251,972 | A | 10/1993 | Zurawin |
| 5,289,943 | A | 3/1994 | Powell |
| 5,314,078 | A | 5/1994 | Morikiyo et al. |
| 5,328,258 | A | 7/1994 | Scalise |
| 5,344,066 | A | 9/1994 | Fogle |
| 5,356,033 | A | 10/1994 | Delaney |
| 5,372,278 | A | 12/1994 | Leight |
| 5,390,821 | A | 2/1995 | Markel |
| 5,396,997 | A | 3/1995 | Johnson |
| D363,174 | S | 10/1995 | Fletcher |
| 5,462,198 | A | 10/1995 | Schwimmer |
| 5,529,207 | A | 6/1996 | Oden et al. |
| 5,638,988 | A | 6/1997 | Rogers et al. |
| 5,685,664 | A | 11/1997 | Parham et al. |
| 5,740,610 | A | 4/1998 | Ayer et al. |
| 5,788,117 | A | 8/1998 | Zimmanck |
| 5,791,048 | A | 8/1998 | Bodnar et al. |
| 5,836,478 | A | 11/1998 | Weiss |
| 5,878,862 | A | 3/1999 | Dewsnap |
| 5,894,942 | A | 4/1999 | Miyashita et al. |
| 5,924,573 | A | 7/1999 | Piraneo et al. |
| 5,992,286 | A | 11/1999 | Boole |
| 5,992,652 | A | 11/1999 | Springs |
| 6,186,345 | B1 | 2/2001 | Robertson |
| 6,199,720 | B1 | 3/2001 | Rudick et al. |
| 6,206,237 | B1 | 3/2001 | Dillon et al. |
| 6,253,930 | B1 | 7/2001 | Freidus et al. |
| 6,267,258 | B1 | 7/2001 | Wilkerson et al. |
| 6,393,799 | B2 | 5/2002 | Jenkins et al. |
| 6,453,641 | B1 | 9/2002 | Puckett |
| 6,637,604 | B1 | 10/2003 | Jay |
| 6,802,433 | B2 | 10/2004 | Leykin et al. |
| 6,991,116 | B2 | 1/2006 | Johnson et al. |
| 7,207,447 | B2 | 4/2007 | Medcalf et al. |
| 7,296,731 | B2 | 11/2007 | Auclair et al. |
| 7,303,095 | B2 | 12/2007 | Nagelski et al. |
| 7,331,507 | B2 | 2/2008 | Sutherland et al. |
| 7,546,973 | B2 | 6/2009 | Budz et al. |
| 7,584,854 | B2 | 9/2009 | Chandaria |
| 7,614,543 | B1 | 11/2009 | Miller |
| D604,972 | S | 12/2009 | Henry et al. |
| 7,665,618 | B2 | 2/2010 | Jay et al. |
| 7,681,745 | B2 | 3/2010 | Richter |
| 7,690,518 | B2 | 4/2010 | Fincher et al. |
| 7,757,890 | B2 | 7/2010 | Alford et al. |
| 7,810,672 | B1 | 10/2010 | Mason et al. |
| 7,823,733 | B2 | 11/2010 | Futori |
| 7,841,479 | B2 | 11/2010 | Budge et al. |
| 7,850,015 | B1 | 12/2010 | Mason |
| 7,913,860 | B2 | 3/2011 | Merl |
| 7,918,365 | B2 | 4/2011 | White et al. |
| 7,922,437 | B1 | 4/2011 | Loftin et al. |
| 7,992,747 | B2 | 8/2011 | Bauer |
| 8,028,855 | B2 | 10/2011 | White et al. |
| 8,047,400 | B1 | 11/2011 | Luberto et al. |
| 8,302,809 | B1 | 11/2012 | Bogdziewicz et al. |
| 8,308,023 | B2 | 11/2012 | Gelardi et al. |
| 8,322,543 | B2 * | 12/2012 | Gelardi et al. ..... 211/59.2 |
| 8,628,003 | B2 * | 1/2014 | Thomas et al. ..... 229/240 |
| 8,668,114 | B2 * | 3/2014 | Gelardi et al. ..... 221/285 |
| 2002/0043509 | A1 | 4/2002 | Lajeunesse et al. |
| 2003/0136819 | A1 | 7/2003 | Walsh et al. |
| 2003/0173322 | A1 | 9/2003 | Rushing |
| 2004/0011751 | A1 | 1/2004 | Johnson et al. |
| 2004/0040334 | A1 | 3/2004 | Rusnock |
| 2004/0079760 | A1 | 4/2004 | Rink |
| 2004/0262326 | A1 | 12/2004 | Christensen |
| 2005/0092644 | A1 | 5/2005 | Cafferata et al. |
| 2005/0127015 | A1 | 6/2005 | Medcalf et al. |
| 2005/0207877 | A1 | 9/2005 | Haverdink et al. |

(56) References Cited

U.S. PATENT DOCUMENTS

| | | | | |
|---|---|---|---|---|
| 2006/0081692 | A1 | 4/2006 | Stewart et al. | |
| 2006/0131370 | A1 | 6/2006 | Bates | |
| 2006/0237384 | A1 | 10/2006 | Neumann et al. | |
| 2006/0243683 | A1 | 11/2006 | Onachilla et al. | |
| 2006/0255112 | A1 | 11/2006 | Sweet | |
| 2006/0278591 | A1 | 12/2006 | Tippets et al. | |
| 2007/0080199 | A1 | 4/2007 | Sutherland | |
| 2007/0108261 | A1 | 5/2007 | Schuster | |
| 2007/0194037 | A1 | 8/2007 | Close | |
| 2008/0245813 | A1 | 10/2008 | Johnson et al. | |
| 2009/0212066 | A1 | 8/2009 | Bauer | |
| 2009/0266776 | A1 | 10/2009 | Johnson | |
| 2009/0277853 | A1 | 11/2009 | Bauer | |
| 2009/0308885 | A1 | 12/2009 | Sainato et al. | |
| 2010/0032391 | A1 | 2/2010 | Schneider et al. | |
| 2010/0096401 | A1 | 4/2010 | Sainato et al. | |
| 2011/0121010 | A1 | 5/2011 | Loftin et al. | |
| 2011/0121011 | A1 | 5/2011 | Gelardi et al. | |
| 2011/0121022 | A1 | 5/2011 | Sholl et al. | |
| 2012/0018391 | A1 | 1/2012 | Gelardi et al. | |
| 2012/0074016 | A1 | 3/2012 | Gelardi et al. | |
| 2012/0074160 | A1 | 3/2012 | Thomas et al. | |
| 2012/0074164 | A1 | 3/2012 | Walling et al. | |
| 2012/0080513 | A1 | 4/2012 | Thomas et al. | |
| 2012/0097694 | A1 | 4/2012 | Gelardi | |
| 2012/0152970 | A1 | 6/2012 | Thomas | |
| 2012/0211522 | A1 | 8/2012 | Gelardi et al. | |
| 2012/0217213 | A1 | 8/2012 | Thomas | |
| 2012/0217261 | A1 | 8/2012 | Bailey et al. | |
| 2012/0223090 | A1 | 9/2012 | Thomas et al. | |
| 2012/0279893 | A1 | 11/2012 | Gelardi et al. | |
| 2012/0285976 | A1 | 11/2012 | Bogdziewicz et al. | |
| 2012/0285977 | A1 | 11/2012 | Bates et al. | |
| 2013/0277385 | A1* | 10/2013 | Zacherle | 229/240 |
| 2014/0061217 | A1* | 3/2014 | Fortuna et al. | 221/1 |

FOREIGN PATENT DOCUMENTS

| | | | | |
|---|---|---|---|---|
| DE | 29808673 | U1 | 11/1998 | |
| DE | 19808162 | A1 | 9/1999 | |
| DE | 20111307 | U1 | 10/2001 | |
| DE | 202007012114 | U1 | 11/2007 | |
| FR | 2415051 | A1 | 8/1979 | |
| GB | 1283210 | A | 7/1972 | |
| GB | 2036706 | A * | 1/1980 | A47F 1/087 |
| GB | 2190906 | A | 12/1987 | |
| GB | 2303624 | A | 2/1997 | |
| JP | 03105494 | A | 5/1991 | |
| JP | 03133737 | A | 6/1991 | |
| JP | 03198192 | A | 8/1991 | |
| JP | 03273469 | A | 12/1991 | |
| JP | 03273470 | A | 12/1991 | |
| JP | 03273471 | A | 12/1991 | |
| JP | 03273474 | A | 12/1991 | |
| JP | 03273476 | A | 12/1991 | |
| JP | 03273480 | A | 12/1991 | |
| JP | 03273482 | A | 12/1991 | |
| JP | 03273483 | A | 12/1991 | |
| JP | 04086985 | A | 3/1992 | |
| JP | 04115392 | A | 4/1992 | |
| JP | 04137194 | A | 5/1992 | |
| JP | 04157593 | B1 | 5/1992 | |
| JP | 05004640 | A | 1/1993 | |
| JP | 05174239 | A | 7/1993 | |
| JP | 05346984 | A | 12/1993 | |
| JP | 08161611 | A | 6/1996 | |
| JP | 09027066 | A | 1/1997 | |
| JP | 09102065 | A | 4/1997 | |
| JP | 09282537 | A | 10/1997 | |
| JP | 09311971 | A | 12/1997 | |
| JP | 10269421 | A | 10/1998 | |
| JP | 11011471 | A | 1/1999 | |
| JP | 11171264 | A | 6/1999 | |
| JP | 03273472 | A | 7/1999 | |
| JP | 03273477 | A | 7/1999 | |
| JP | 11191175 | A | 7/1999 | |
| JP | 11328513 | A | 11/1999 | |
| JP | 2001072076 | A | 3/2001 | |
| JP | 2001206358 | A | 7/2001 | |
| JP | 2003327243 | A | 11/2003 | |
| JP | 2004017970 | A | 1/2004 | |
| JP | 2005338910 | A | 12/2005 | |
| WO | WO9106076 | A1 | 5/1991 | |
| WO | WO9321074 | A1 | 10/1993 | |
| WO | WO9423619 | A1 | 10/1994 | |
| WO | WO0054632 | A1 | 9/2000 | |
| WO | WO2004014755 | A1 | 2/2004 | |
| WO | WO2004113808 | A1 | 12/2004 | |
| WO | WO2009029603 | A2 | 3/2009 | |
| WO | WO2009138538 | A1 | 11/2009 | |
| WO | WO-2011/025483 | A1 * | 3/2011 | A47F 1/087 |
| WO | WO2011025483 | A1 | 3/2011 | |
| WO | WO2011030320 | A1 | 3/2011 | |
| WO | WO2011109350 | A1 | 9/2011 | |

OTHER PUBLICATIONS

International Search Report and Written Opinion for PCT/US2010/057221, Mar. 4, 2011.

International Search Report and Written Opinion for PCT/US2011/051959, Mar. 26, 2013.

* cited by examiner

PRODUCT DISPENSING CONTAINER, SYSTEM AND METHOD WITH PRIMING AREA

PRIORITY

This application is a divisional of U.S. Ser. No. 13/039,688 filed on Mar. 3, 2011, which is a continuation-in-part of U.S. Ser. No. 12/890,631 filed on Sep. 25, 2010. The entire contents of U.S. Ser. Nos. 12/890,631 and Ser. No. 13/039,688 are incorporated herein by reference.

FIELD

This application relates to the dispensing of products from packaging containers and, more particularly, to packaging containers configured to cooperate with product dispensers to dispense products.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. patent application Ser. No. 12/777,444 filed on May 11, 2010, the entire contents of which are incorporated herein by reference, discloses a new system for dispensing and displaying products packaged in a container. Specifically, the product dispensing system includes a dispenser having a support structure, a product display area and an opening tool. The dispenser may be positioned on a retailer's shelf and loaded with product simply by placing a container comprising multiple units of product onto the support structure of the dispenser. As the container is being placed onto the support structure, the opening tool of the dispenser opens the container in such a manner that product rolls from the container and down to the product display area of the dispenser under the force of gravity.

Despite advances in the field, those skilled in the art continue with research and development efforts directed to apparatus and systems for dispensing products from packaging containers.

SUMMARY

In one aspect, the disclosed product dispensing container may include a plurality of walls that define an internal volume, at least one of the walls including an access door, a priming area and a severance line, and a plurality of products received in the internal volume, wherein the priming area is displaceable relative to the wall to form a free edge, and wherein the access door is at least partially defined by the free edge and the severance line when the priming area is displaced relative to the wall.

In another aspect, the disclosed product dispensing system may include (1) a container including a plurality of walls that define an internal volume, at least one of the walls including an access door, a priming area and a severance line, the priming area being displaceable relative to the wall to form a free edge such that the access door is at least partially defined by the free edge and the severance line, (2) a plurality of products received in the internal volume, and (3) a dispenser including a frame having a front end and a rear end, the frame including a support deck and a product display area, the support deck extending between the front end and the rear end, the product display area being positioned below the support deck proximate the front end, and an opening tool positioned to sever the severance line as the container is moved along the support deck, wherein the access door pivots relative to the container when the priming area has been displaced and the severance line has been severed, thereby releasing at least one product from the container to the product display area.

In yet another aspect, disclosed is a method for dispensing products. The method may include the steps of (1) providing a container including a plurality of walls that define an internal volume and housing a plurality of products in the internal volume, at least one of the walls including an access door, a priming area and a severance line, (2) providing a dispenser that includes a frame having a front end and a rear end, the frame including a support deck and a product display area, the support deck extending between the front end and the rear end, the product display area being positioned below the support deck proximate the front end, and an opening tool associated with the frame, (3) displacing the priming area relative to the wall to form a free edge, the access door being at least partially defined by the free edge and the severance line after the displacing step, and (4) sliding the container relative to the opening tool along the support deck such that the opening tool severs the severance line to allow the access door to pivot and release at least one of the products from the container to the product display area.

Other aspects of the disclosed product dispensing container, system and method with priming area will become apparent from the following detailed description, the accompanying drawings and the appended claims.

DETAILED DESCRIPTION

Figure 1:
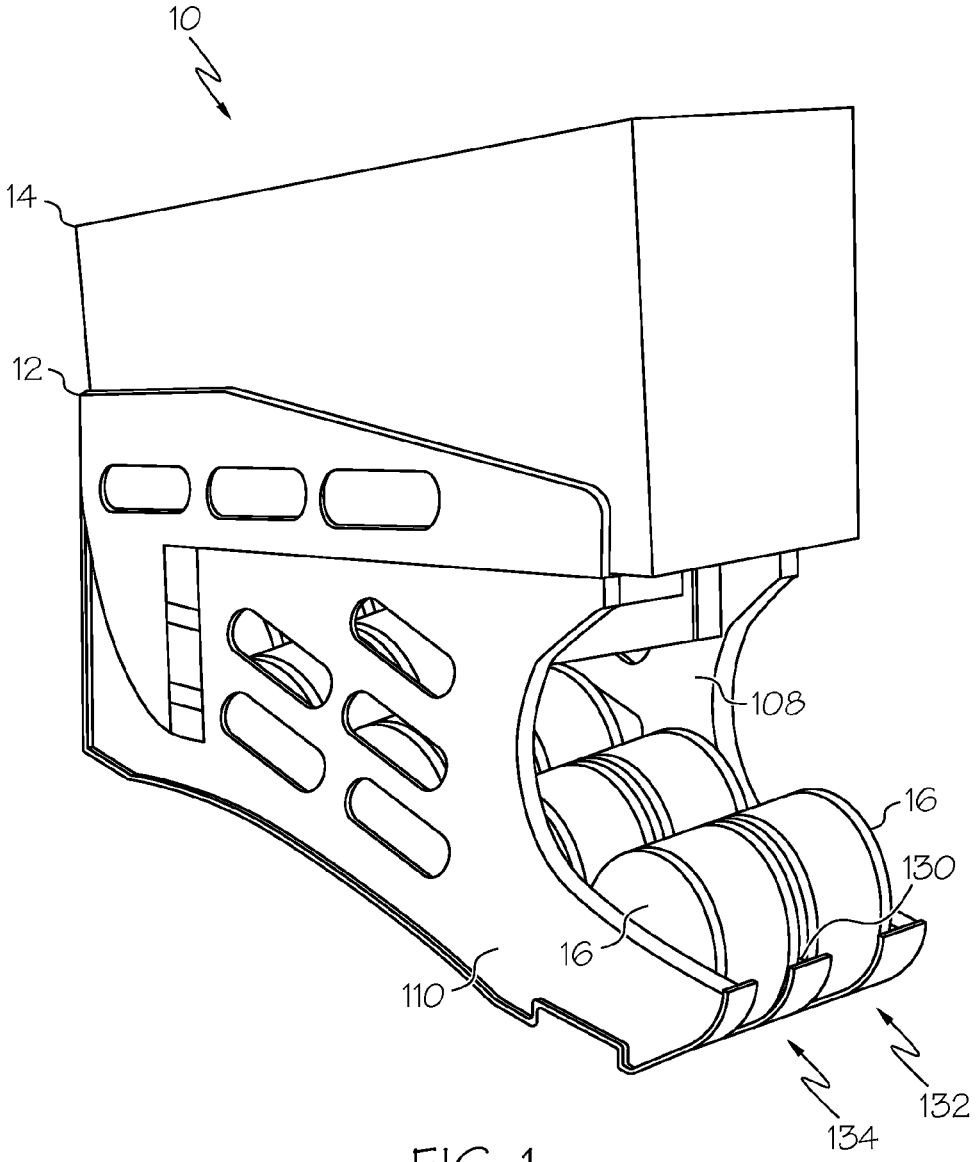
FIG. 1 is a front and side perspective view of one aspect of the disclosed product dispensing system with priming area.

Referring to FIG. 1, one aspect of the disclosed product dispensing system with priming area, generally designated 10, may include a dispenser 12 and a container 14. The container 14 may house multiple units of product 16, such as cans (e.g., canned food), jars (e.g., jarred sauce) or bottles (e.g., bottled soft drinks). As described in greater detail below, the container 14 may initially be primed by displacing a priming area (described below), and then may be loaded onto the dispenser 12 such that the dispenser 12 may open the container 14 to release the products 16 from the container 14 to the dispenser 12.

The container 14 may be any container capable of housing products 16, being primed, and interacting with the disclosed dispenser 12 to release products 16 to the dispenser 12. For example, the container 14 may be a paperboard carton or a corrugated box. Optionally, at least one major surface of the container 14 may be marked with various indicia, such as printed text and/or graphics.

Figure 2:
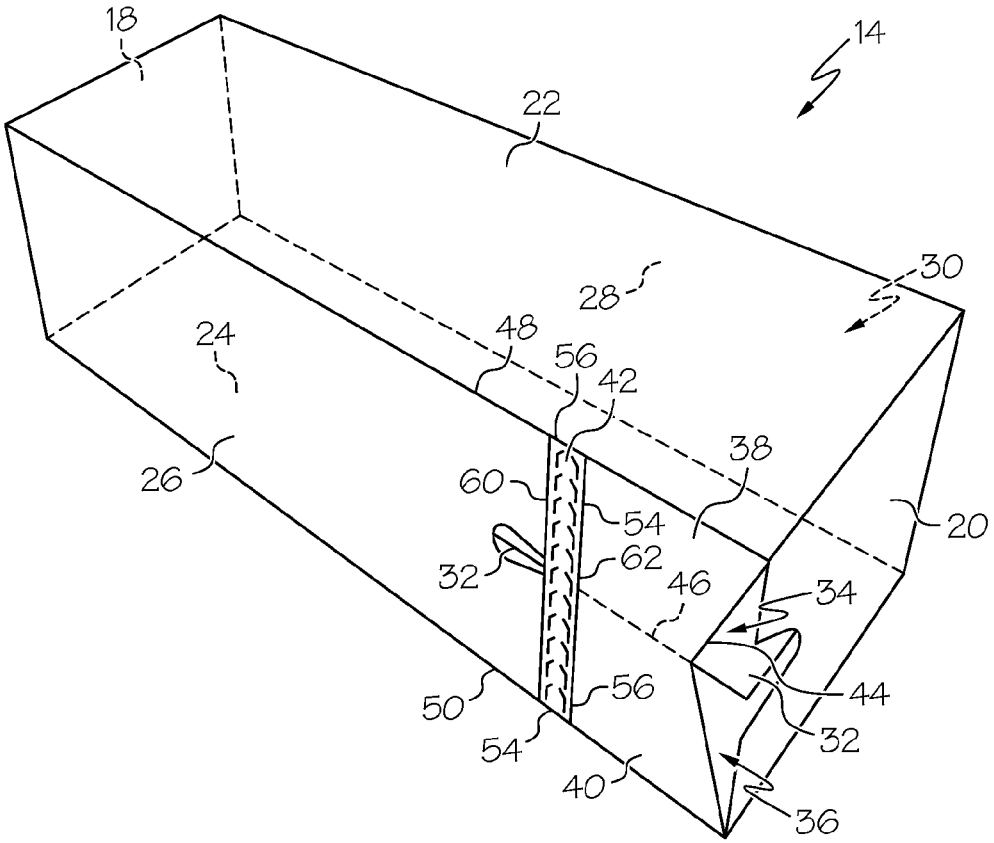
FIG. 2 is a rear and bottom perspective view of the container of the product dispensing system of FIG. 1.
Figure 4:
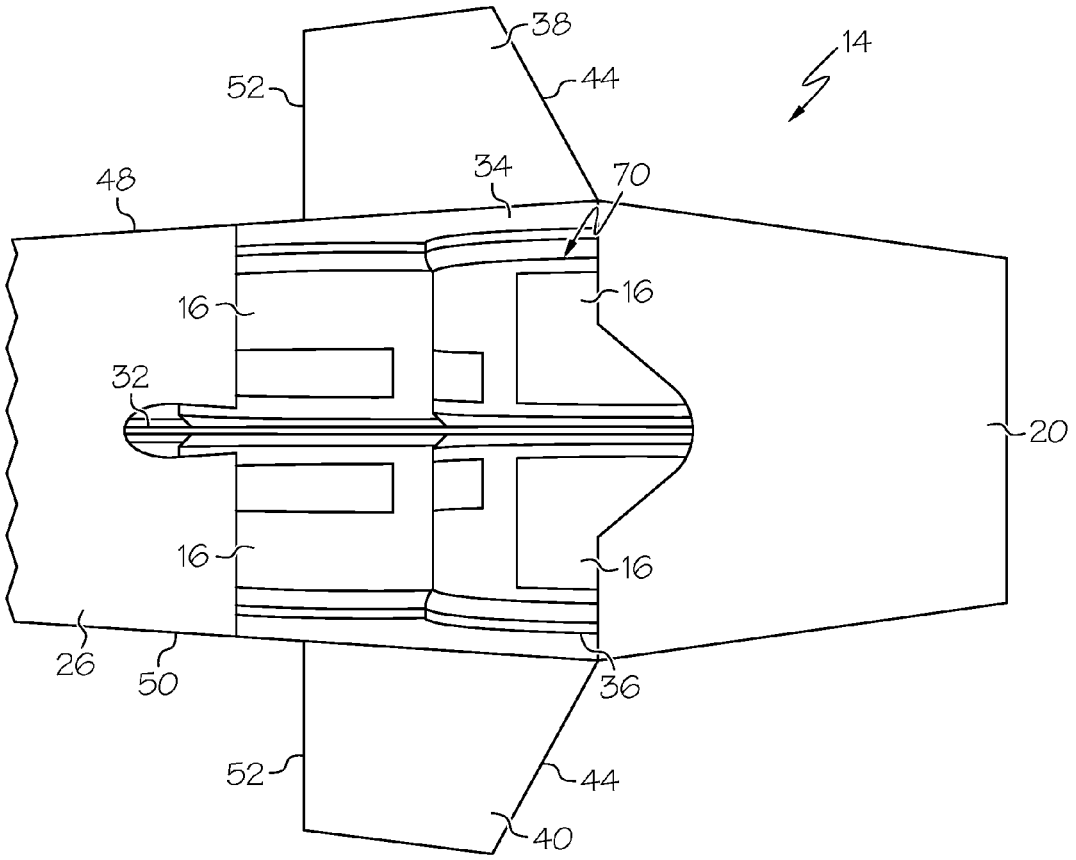
FIG. 4 is bottom and rear perspective view of a portion of the container of FIG. 3 shown in an open configuration.

As shown in FIG. 2, in one particular construction, the container 14 may be a generally rectilinear container having six walls 18, 20, 22, 24, 26, 28 that define an internal volume 30 for receiving the products 16 (FIG. 4). Opposed walls 18 and 20 may define the front and rear walls, respectively, of the container 14. Opposed walls 22 and 24 may define the first (e.g., right) and second (e.g., left) side walls, respectively, of the container 14. Opposed walls 26 and 28 may define the base and upper walls, respectively, of the container 14.

Optionally, the container 14 may include a partition 32 extending therethrough to divide the internal volume 30 into a first chamber 34 and a second chamber 36. The partition 32 may be a generally planar structure that is generally parallel with, but spaced apart from, the right 22 and left 24 side walls. Therefore, as shown in FIG. 4, a first quantity of product 16 may be housed in the first chamber 34 and a second quantity of product 16 may be housing in the second chamber 36.

Figure 6:
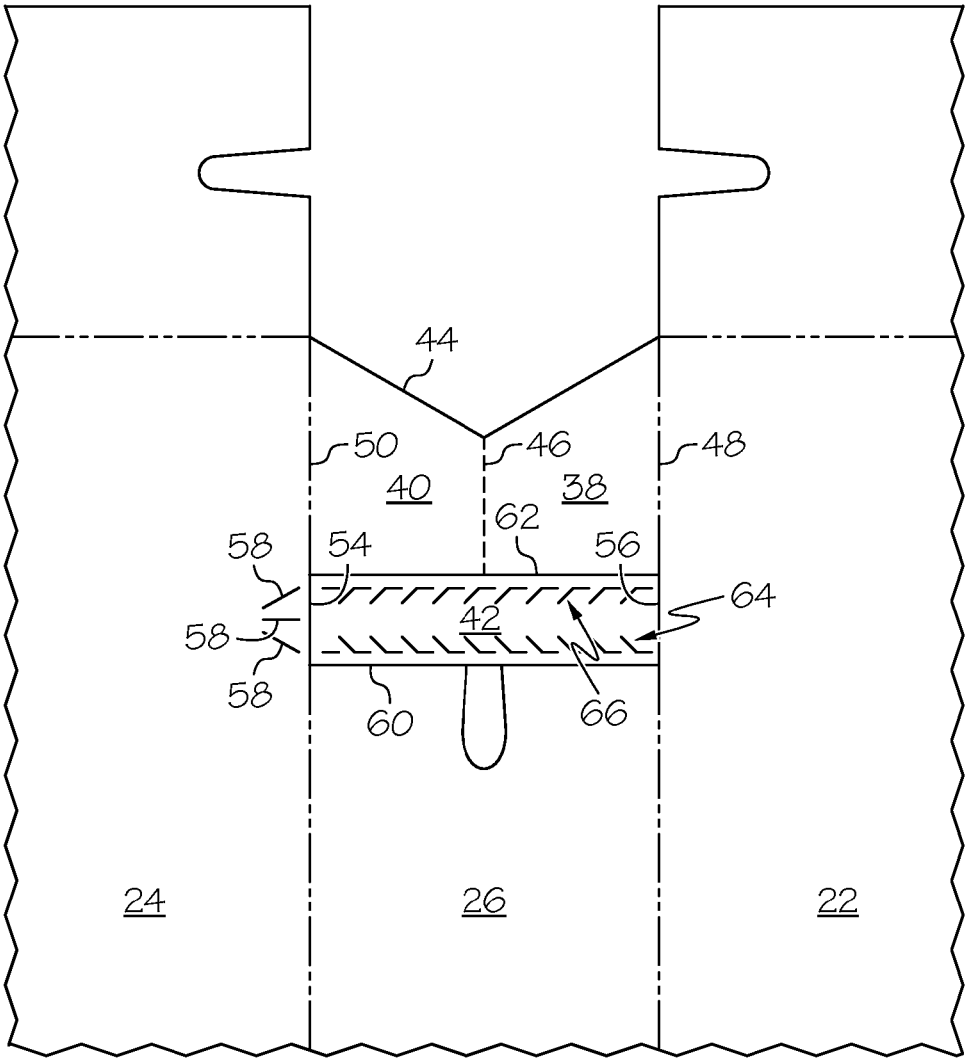
FIG. 6 is detailed, top plan view of a portion of the container blank of FIG. 5.

As shown in FIGS. 2 and 6, the base wall 26 of the container 14 may include first and second access doors 38, 40, a priming area 42, a rear edge 44 and a severance line 46. The first access door 38 may be defined by the priming area 42, the rear edge 44, the severance line 46 and the edge 48 between the base wall 26 and the right side wall 22. The second access door 40 may be defined by the priming area 42, the rear edge 44, the severance line 46 and the edge 50 between the base wall 26 and the left side wall 24.

The priming area 42 may be a panel or the like. For example, the priming area 42 may be a priming panel formed in the base wall 26 of the container 14.

Figure 3:
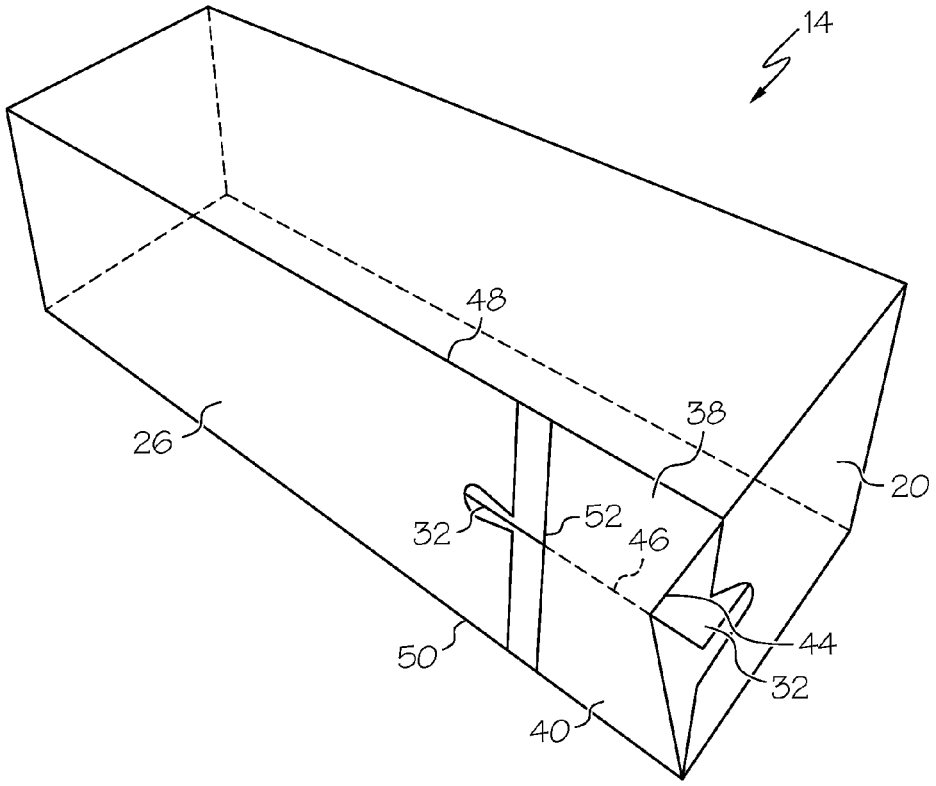
FIG. 3 is a rear and bottom perspective view of the container of FIG. 2 shown with the priming area removed.

As shown in FIG. 3, the priming area 42 may be removed from the base wall 26 of the container 14 to define a forward edge 52 of the first and second access doors 38, 40. The forward edge 52 may be free (i.e., not connected to adjacent structure). Therefore, with the priming area 42 displaced, the first access door 38 may be defined by the forward edge 52, the rear edge 44, the severance line 46 and edge 48, and the second access door 40 may be defined by the forward edge 52, the rear edge 44, the severance line 46 and edge 50.

Referring back to FIGS. 2 and 6, the priming area 42 may laterally extend across the base wall 26 of the container 14. The priming area 42 may include a first (left) edge 54 positioned proximate (i.e., at or near) the edge 50 between the base wall 26 and the left side wall 24, and second, (right) edge 56 positioned proximate the edge 48 between the base wall 26 and the right side wall 22.

The left edge 54 and/or the right edge 56 of the priming area 42 may be free (i.e., not connected to adjacent structure) such that a user may grasp the left and/or right edges 54, 56 of the priming area 42, such as to apply a pulling force to the priming area 42. For example, the edge 50 between the base wall 26 and the left side wall 24 may be cut along the priming area 42 such that the left edge 54 of the priming area 42 is free.

Optionally, as shown in FIG. 6, pre-formed creases 58 may be formed in the left side wall 24 proximate the left edge 54 of the priming area 42 to facilitate grasping of the left edge 54 of the priming area 42.

The priming area 42 may further include a front edge 60 and a rear edge 62. The rear edge 62 of the priming area 42 may form the forward edge 52 of the first and second access doors 38, 40 when the priming area 42 is removed from the container 14. The longitudinal spacing between the front edge 60 and the rear edge 62 may define the longitudinal width of the priming area 42.

As shown in FIG. 6, a first weakened severance line 64 may laterally extend along the front edge 60 of the priming area 42 from proximate the left edge 54 to proximate the right edge 56. A second weakened severance line 66 may laterally extend along the rear edge 62 of the priming area 42 from proximate the left edge 54 to proximate the right edge 56. The weakened severance lines 64, 66 may facilitate the separation of the priming area 42 from the base wall 26 of the container 14.

As a first example, the first and second weakened severance lines 64, 66 may be formed as rows of cuts, as shown in greater detail in FIG. 6. Each cut of the rows of cuts 64, 66 may include a straight portion extending generally parallel with the respective edge 60, 62 and an angled portion extending inward (relative to the respective edge 60, 62) from the straight portion. Therefore, the priming area 42 may function as a zipper strip, and may be removed from the base wall 26 of the container 14 by tearing the priming area 42 from the base wall 26 along the rows of cuts 64, 66.

As a second example, the first and second weakened severance lines 64, 66 may be formed as rows of perforations, such as standard perforations or micro perforations. Therefore, the priming area 42 may be removed from the base wall 26 of the container 14 by tearing the priming area 42 from the base wall 26 along the perforations.

Those skilled in the art will appreciate that various weakening techniques may be used to facilitate the separation of the priming area 42 from the base wall 26 of the container 14 without departing from the scope of the present disclosure.

The rear edge 44 may laterally extend across the base wall 26 of the container 14 proximate the rear wall 20 of the container 14. Optionally, the rear edge 44 of the base wall 26 may be contoured to guide an opening tool (discussed below) to the severance line 46 and/or such that the dispenser 12 does not interfere with the movement of the first and second access doors 38, 40 as the access doors 38, 40 are opened to dispense products 16. For example, the rear edge 44 of the base wall 26 may be generally V-shaped, and the severance line 46 may extend toward the base of the "V" of the V-shaped rear edge 44.

The severance line 46 may longitudinally extend from proximate the priming area 42 to proximate the rear edge 44. For example, the severance line 46 may be generally centered between the right and left side walls 22, 24, and may extend along the base wall 26 in a generally straight line from the priming area 42 to the rear edge 44.

The severance line 46 may be weakened to make it easier to sever the severance line 46. However, the severance line 46 may have sufficient strength such that the severance line 46 is not severed merely due to the weight of the products 16 housed in the container 14 acting on the first and second access doors 38, 40. Several examples of techniques that may be used to weaken the severance line 46 include forming perforations in the container 14 along the severance line 46, scoring the container 14 and forming a crease in the container 14.

As shown in FIG. 4, when the priming area 42 is removed from the container 14 and the severance line 46 is severed, the first and second access doors 38, 40 may pivot laterally outward (i.e., toward the side walls 22, 24) along the edges 48, 50 between the base wall 26 and the side walls 22, 24, thereby forming an opening 70 in the container 14 that provides access to the internal volume 30, and through which the products 16 may exit the container 14.

As described in greater detail herein, the severance line 46 may be severed as the container 14 is loaded onto the dispenser 12.

Figure 5:
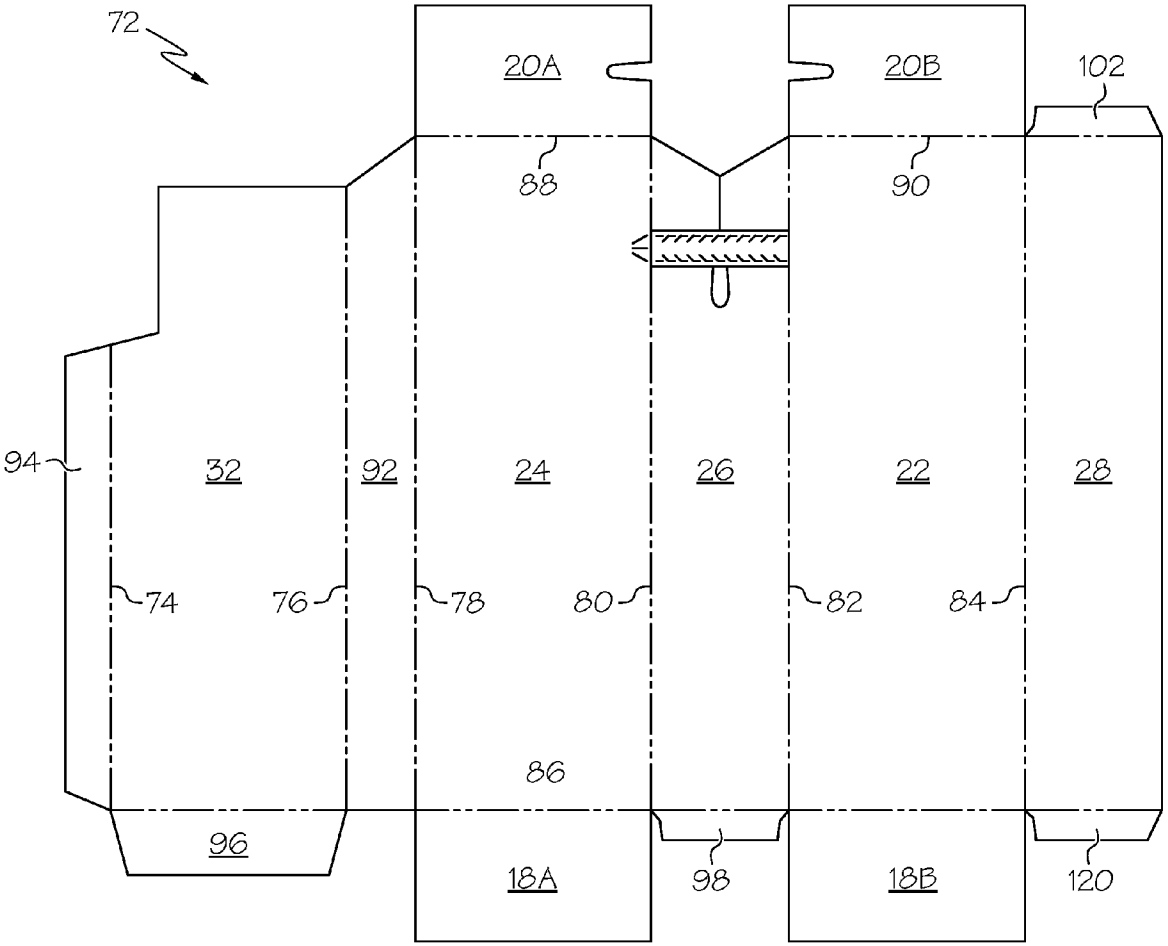
FIG. 5 is a top plan view of a container blank that may be used to form the container of FIG. 2.

The container 14 may be formed from a paperboard container blank, such as the paperboard container blank 72 shown in FIG. 5. The container blank 72 may include a plurality of pre-formed fold lines 74, 76, 78, 80, 82, 84, 86, 88, 90 that define the front wall 18 (comprised of front wall panels 18A and 18B), the rear wall 20, (comprised of rear wall panels 20A and 20B), the right side wall 22, the left side wall 24, the base wall 26, the upper wall 28, the partition 32, a transition panel 92 and sealing flaps 94, 96, 98, 100, 102.

The container 14 may be assembled by folding the container blank 72 along the longitudinal fold lines 74, 76, 78, 80, 82, 84 and connecting the upper wall 28 to the transition panel 92 to form the three-dimensional body of the container 14. Additionally, sealing flap 94 may be connected to the base wall 26 to secure the partition 32 between the side walls 22, 24 of the container 14. Then, the front wall panels 18A, 18B and the sealing flaps 96, 98, 100 may be assembled to form the front wall 18 of the container 14. Finally, the rear wall panels 20A, 20B and the sealing flap 102 may be assembled to form the rear wall 20 of the container 14.

While a specific paperboard container blank 72 is shown and described, those skilled in the art will appreciate that various techniques and materials may be used to form the container 14. Folded paperboard containers are only one specific and non-limiting example of the disclosed container 14.

Figure 7:
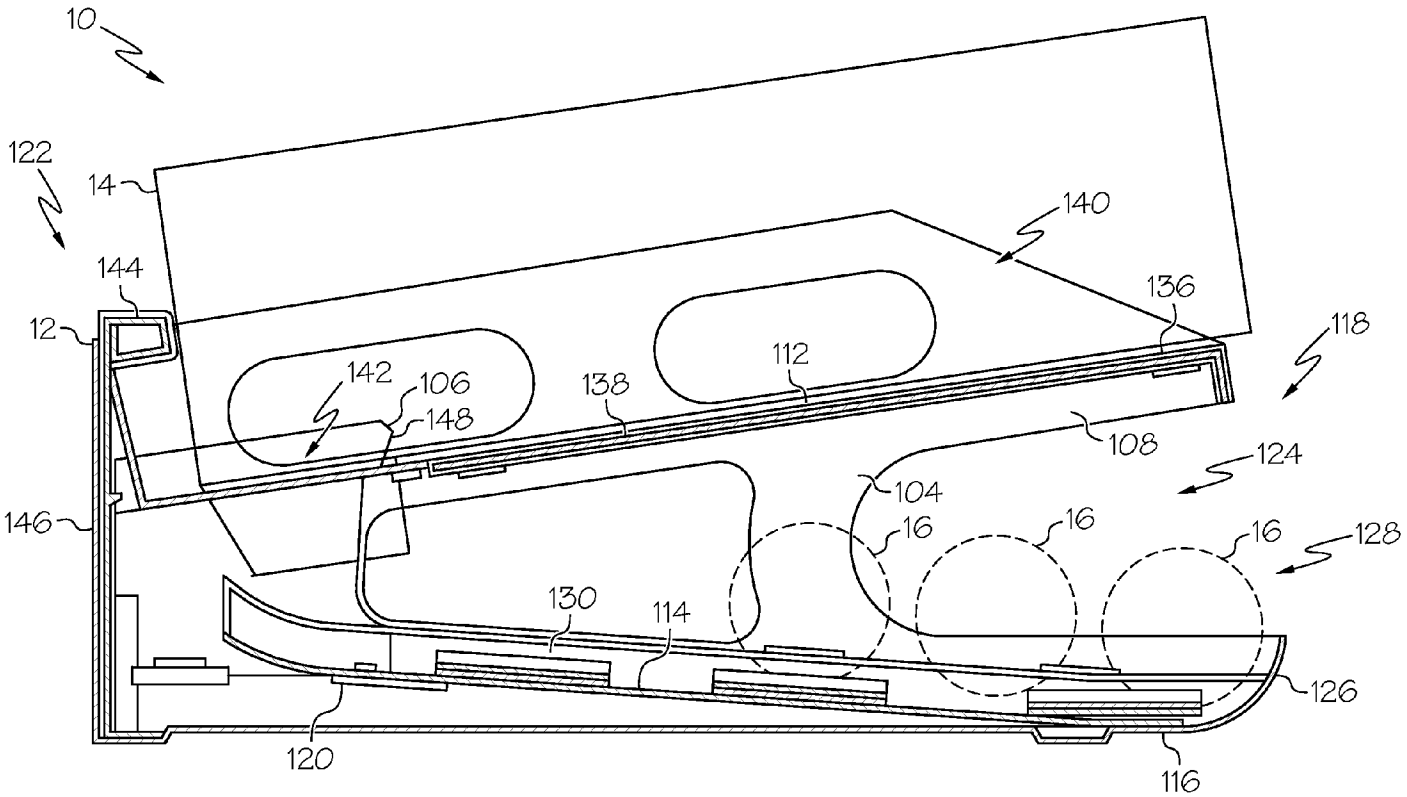
FIG. 7 is a side elevational view, in section, of the product dispensing system of FIG. 1.

Referring to FIG. 7, the dispenser 12 may include a frame 104 and an opening tool 106. The frame 104 of the dispenser 12 may support the container 14 in a desired configuration. The opening tool 106 may sever the severance line 46 (FIG. 2) to allow the first and second access doors 38, 40 to open as the container 14 is loaded onto the frame 104 of the dispenser 12.

The frame 104 may include a first (e.g., right) side wall 108, a second (e.g., left) side wall 110 (FIG. 1), an upper support deck 112 and a lower support deck 114. The right side wall 108 may be laterally spaced from the left side wall 110, and may be generally parallel with the left side wall 110.

The lower support deck 114 may laterally extend between the right 108 and left 110 side walls, and may include a front end 116 that longitudinally extends toward the front end 118 of the frame 104 and a rear end 120 that longitudinally extends toward the rear end 122 of the frame 104. Therefore, the lower support deck 114 and the side walls 108, 110 may define a lower level 124 of the frame 104.

The lower support deck 114 may be inclined from the front end 116 to the rear end 120 (i.e., the rear end 120 may be elevated relative to the front end 116) such that products 16 deposited proximate the rear end 120 of the lower support deck 114 roll down to the front end 116 of the lower support deck 114 under the force of gravity. The extent of the incline of the lower support deck 114 may be dictated by, among other things, the coefficient of friction of the material used to form the frame 104 and the shape of the products 16 to be dispensed by the dispenser 12.

One or more stops 126 may be positioned proximate the front end 116 of the lower support deck 114 to prevent products 16 from rolling beyond the front end 116 of the lower support deck 114. For example, the stop 126 may be connected to (e.g., integral with) the lower support deck 114, and may form an upward curve at the front end 116 of the lower support deck 114. Therefore, the stop 126 may collect products 16 at the front end 116 of the lower support deck 114, thereby defining a product display area 128 at the front end 116 of the lower support deck 114.

As shown in FIGS. 1 and 7, in one particular implementation, the frame 104 may include a divider 130 extending from the front end 116 of the lower support deck 114 to the rear end 120 of the lower support deck 114 to divide the lower level 124 into a first product channel 132 and a second product channel 134. The first product channel 132 may be defined by the lower support deck 114, the right side wall 108 and the divider 130, and may extend from proximate the rear end 120 of the lower support deck 114 to the front end 116 of the lower support deck 114. The second product channel 134 may be defined by the lower support deck 114, the left side wall 110 and the divider 130, and may extend from proximate the rear end 120 of the lower support deck 114 to the front end 116 of the lower support deck 114. While two product channels 132, 134 are shown and described, those skilled in the art will appreciate that the frame 104 may be constructed to provide only one product channel or more than two product channels, without departing from the scope of the present disclosure.

The upper support deck 112 may laterally extend between the right 108 and left 110 side walls, and may include a front end 136 that longitudinally extends toward the front end 118 of the frame 104 and a rear end 138 that longitudinally extends toward, but not to, the rear end 122 of the frame 104. Therefore, the upper support deck 112 and the side walls 108, 110 may define an upper level 140 of the frame 104.

The spacing between the rear end 138 of the upper support deck 112 and the rear end 122 of the frame 104 may define an opening 142, which may function as a chute to allow products 16 to move from the upper level 140 to the lower level 124 of the frame 104 under the force of gravity.

The upper support deck 112 may be declined from the front end 136 to the rear end 138 (i.e., the front end 136 may be elevated relative to the rear end 138). Therefore, products 16 supported by the upper support deck 112 may roll under the force of gravity down to the rear end 128 of the upper support deck 112, through the opening 142, to the lower level 124 of the frame 104 and, ultimately, to the product display area 128.

A stop 144 may be positioned in the upper level 140 of the frame 104 proximate the rear end 122 of the frame 104 to inhibit rearward movement of the container 14 beyond the stop assembly 144.

An optional rear wall 146 may be positioned at the rear end 122 of the frame 104 between the right 108 and left 110 side walls. The stop 144 may be connected to the rear wall 146 such that the rear wall 146 may structurally reinforce the stop 144, and may support the stop 144 in the desired position.

The opening tool 106 may extend into the upper level 140 of the frame 104 to sever the severance line 46 (FIG. 2) of the container 14 as the container 14 is urged along the upper support deck 112 of the frame 104 from the front end 136 of the upper support deck 112 toward the stop 144. The type of opening tool 106 used, as well as the position of the opening tool 106, are design considerations, and may be selected such that the opening tool 106 is capable of opening the container 14 (e.g., severing the severance line 46), but creates little or no interference with the movement of the container 14 along the upper support deck 112.

In one particular construction, the opening tool 106 may include a forward cutting edge 148 positioned (e.g., centered) between the side walls 108, 110 of the frame 104 proximate the rear end 138 of the upper support deck 112. Therefore, the opening tool 106 may sever the severance line 46 (FIG. 2) to allow the first and second access doors 38, 40 to open, as shown in FIG. 4, as the container 14 is urged toward the stop 144.

Accordingly, prior to loading the container 14 onto the dispenser 12, the container 14 may be primed by removing the priming area 42 from the base wall 26 of the container 14. With the priming area 42 removed, the container 14 may then be loaded onto the upper support deck 112 of the dispenser 12. As the container 14 is urged along the upper support deck 112 of the frame 104 toward the stop 144, the opening tool 106 may sever the severance line 46. With the severance line 46 severed, the first and second access doors 38, 40 may swing open through the opening 142 defined by the frame 104 to form the opening 70 (FIG. 4) in the container 14, thereby releasing the products 16 from the container 14 to the dispenser 12 such that the products 16 may move to the product display area 128 under the force of gravity.

Figure 8A:
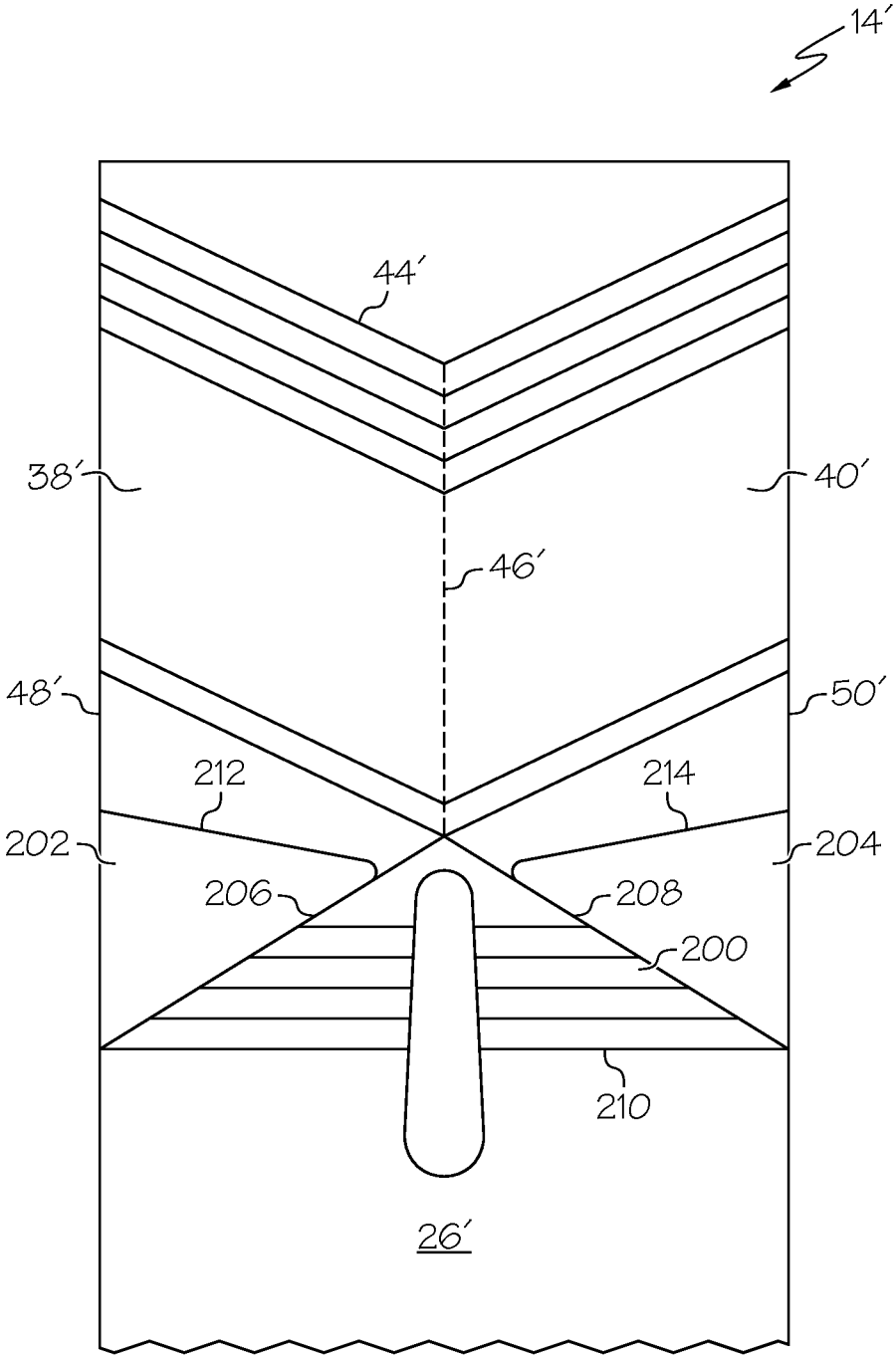
FIG. 8A is a top plan view of the rear portion of the base wall of a container in accordance with a second aspect of the disclosed product dispensing system.

A second aspect of the disclosed product dispensing system with priming area may include the dispenser 12 shown in FIGS. 1 and 7 and the container 14' shown in FIG. 8A. The container 14' shown in FIG. 8A may be generally structurally similar to the container 14 shown in FIG. 2. However, the base wall 26' of the container 14' shown in FIG. 8A may include one or more priming areas 200, 202, 204 configured to be displaced by pressing or punching one or more of the priming areas 200, 202, 204, rather than completely removing the priming areas 200, 202, 204 from the container 14'.

Figure 8B:
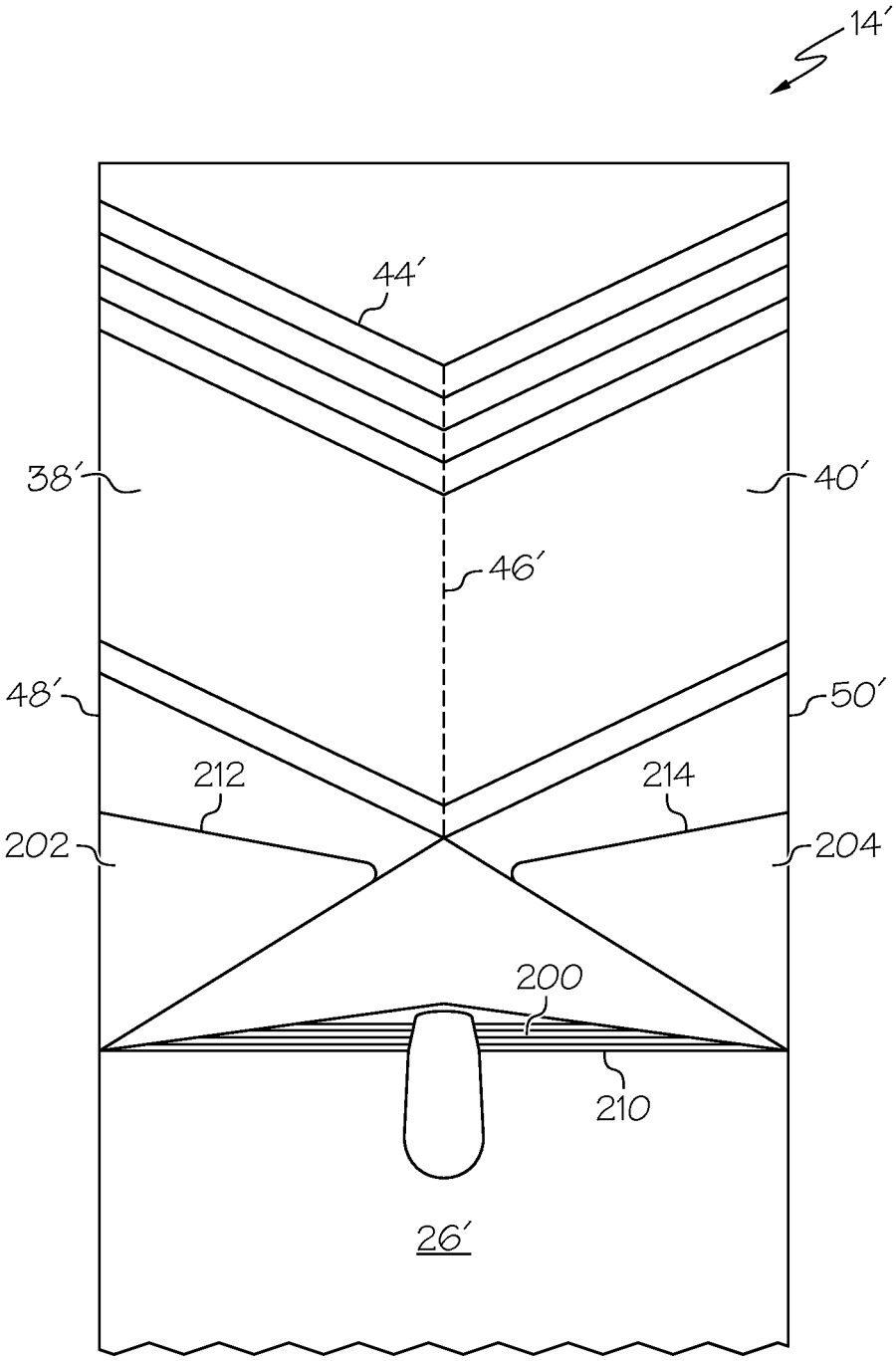
FIG. 8B is a top plan view of the container of FIG. 8A shown in a partially primed configuration.

Priming area 200 may have a generally triangular shape in top view, and may be defined by severance lines 206, 208 and a pre-formed pivot line 210. The severance lines 206, 208 may be weakened, such as with perforations, such that a pressing or punching force applied to the priming area 200 (i.e., a force applied perpendicular to the surface of the base wall 26' into the container 14') may sever the severance lines 206, 208, thereby allowing the priming area 200 to pivot about the pre-formed pivot line 210 into the internal volume of the container 14', as shown in FIG. 8B.

Figure 8C:
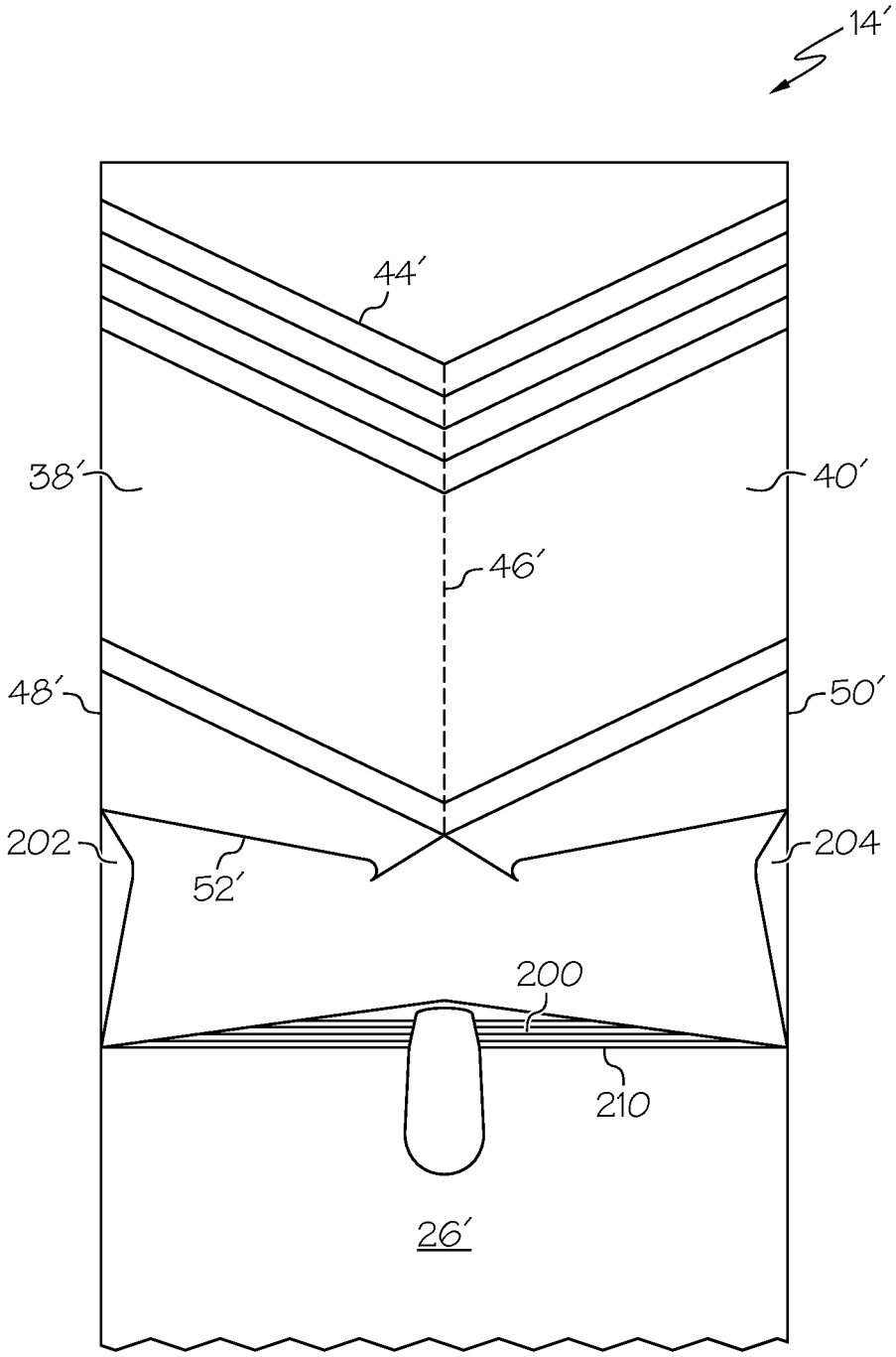
FIG. 8C is a top plan view of the container of FIG. 8B shown in a fully primed configuration.

Priming area 202 may have a generally triangular shape in top view, and may be defined by severance line 206, edge 48' and severance line 212. Priming area 204 may also have a generally triangular shape in top view, and may be defined by severance line 208, edge 50' and severance line 214. Like severance lines 206, 208, severance lines 212, 214 may be weakened, such as with perforations, such that a pressing or punching force applied to the priming areas 202, 204 (i.e., a force applied perpendicular to the surface of the base wall 26' into the container 14') may sever the severance lines 212, 214, thereby allowing the priming areas 202, 204 to pivot along the edges 48', 50', respectively, into the internal volume of the container 14', as shown in FIG. 8C. In one particular construction, priming areas 202, 204 may be displaced as priming area 202 is displaced (i.e., the force applied to priming area 200 may be sufficient to also sever severance lines 212, 214).

Thus, as shown in FIG. 8C, displacing one or more of the priming areas 200, 202, 204 may expose the forward edge 52' of the first and second access doors 38', 40', thereby priming the container 14' and rendering the container 14' ready for loading onto the dispenser 12 (FIGS. 1 and 7).

Figure 9A:
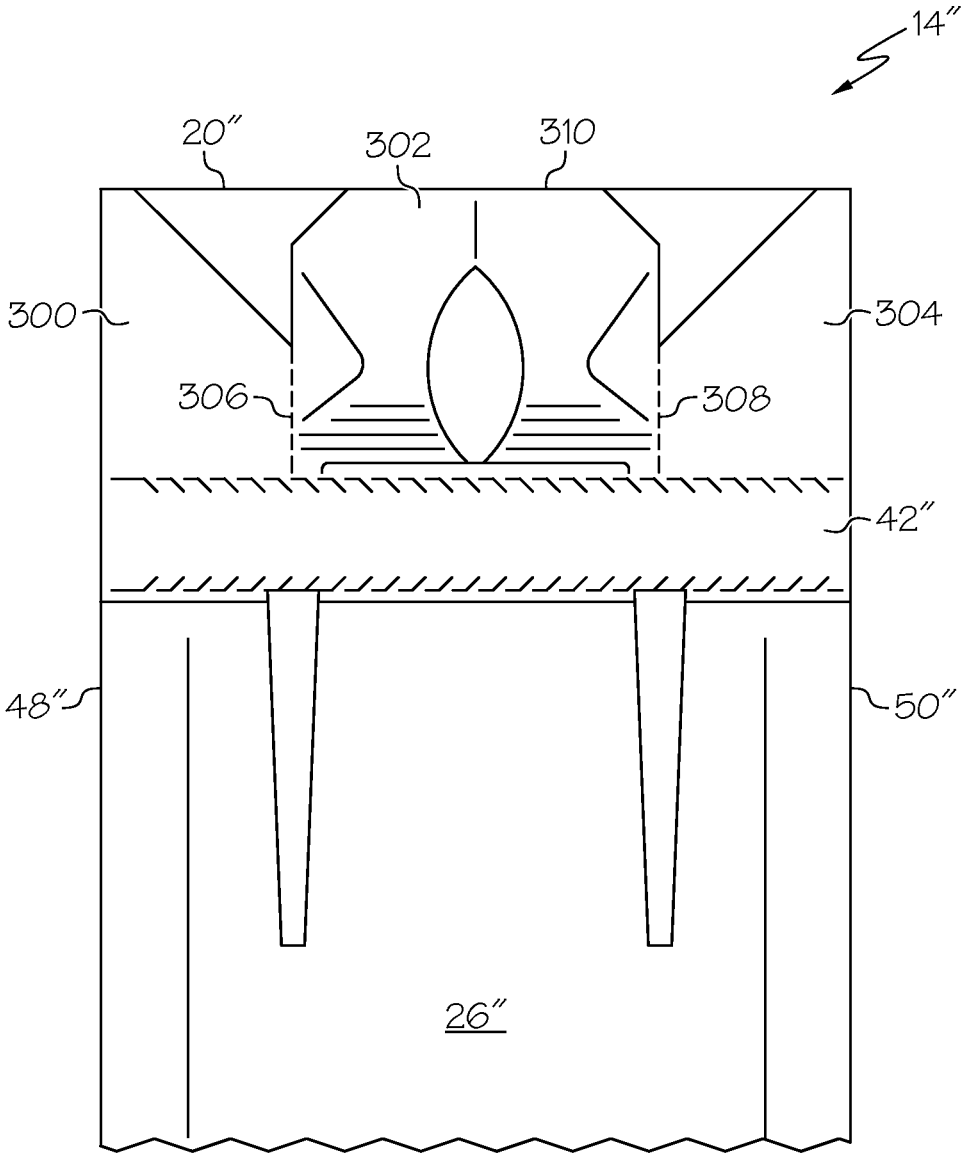
FIG. 9A is a top plan view of the rear portion of the base wall of a container in accordance with a third aspect of the disclosed product dispensing system.

A third aspect of the disclosed product dispensing system with priming area may include the dispenser 12 shown in FIGS. 1 and 7 and the container 14" shown in FIG. 9A. The container 14" shown in FIG. 9A may be generally structurally similar to the container 14 shown in FIG. 2, and may include a removable priming area 42" similar to the removable priming area 42 shown in FIG. 6. However, the base wall 26" of the container 14" shown in FIG. 9A may be configured for use with a four lane dispenser having two opening tools.

Specifically, the base wall 26" of the container 14" may include the priming area 42", a first access door 300, a second access door 302, a third access door 304, a first severance line 306 and a second severance line 308. The first access door 300 may be defined by the priming area 42", the first severance line 306 and the edge 48". The second access door 302 may be defined by the priming area 42", the first severance line 306, the second severance line 308 and the edge 310 (i.e., the edge between the base wall 26" and the rear wall 20"). The third access door 304 may be defined by the priming area 42", the second severance line 308 and the edge 50".

Figure 9B:
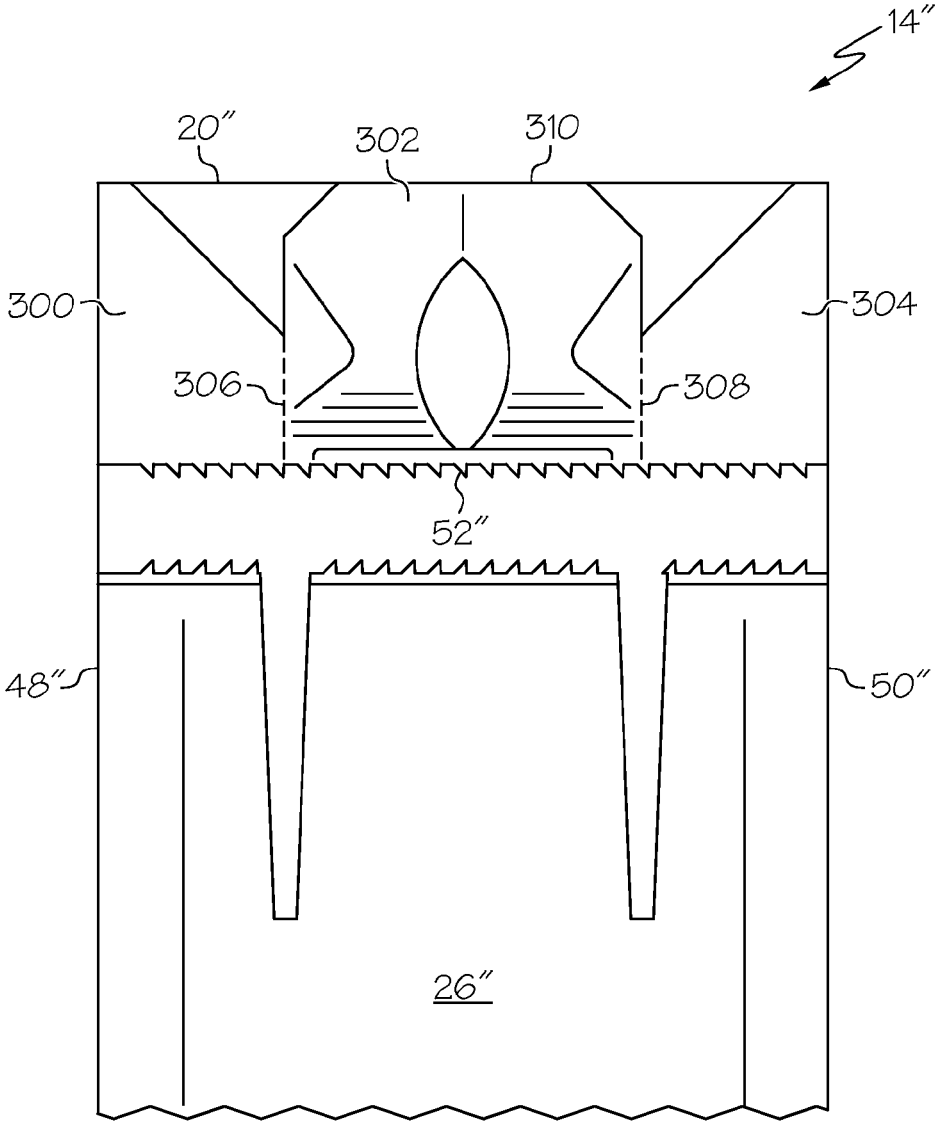
FIG. 9B is a top plan view of the container of FIG. 9A shown in a primed configuration.

Thus, the container 14" may be primed by removing the priming area 42" from the base wall 26" of the container 14" to form the forward edge 52" of the first, second and third access doors 300, 302, 304, as shown in FIG. 9B. Once primed, the container 14" may be loaded onto a dispenser such that the dispenser severs the first and second severance lines 306, 308, thereby allowing the first, second and third access doors 300, 302, 304 to pivot about edges 48", 310, 50", respectively, to release at least some of the products from the container 14" to the dispenser.

Although various aspects of the disclosed product dispensing container and system with priming area have been shown and described, modifications may occur to those skilled in the art upon reading the specification. The present application includes such modifications and is limited only by the scope of the claims.

What is claimed is:

1. A product dispensing system comprising:

a container comprising a plurality of walls that define an internal volume, said plurality of walls comprising a base wall, the base wall comprising an access door, a rear edge, a priming area located apart from the rear edge, and a severance line, said priming area being at least partially displaceable relative to said base wall to form a free edge such that said access door is at least partially defined by said free edge and said severance line;

a plurality of products received in said internal volume; and a dispenser comprising:

a frame having a front end and a rear end, said frame comprising a support deck and a product display area, said support deck extending between said front end and said rear end; and an opening tool positioned to sever said severance line as said container is moved along said support deck, wherein said access door pivots relative to said container when said priming area has been displaced and said severance line has been severed so as to release at least one product of said plurality of products from said container to said product display area.

2. The product dispensing system of claim 1 wherein said container comprises paperboard.

3. The product dispensing system of claim 1 wherein said priming area comprises a first weakened severance line and a second weakened severance line.

4. The product dispensing system of claim 3 wherein said first weakened severance line is spaced apart from, and generally parallel with, said second weakened severance line.

5. The product dispensing system of claim 3 wherein said first weakened severance line intersects said second weakened severance line.

6. The product dispensing system of claim 5 wherein said severance line extends proximate said intersection of said first and said second weakened severance lines.

7. The product dispensing system of claim 3 wherein said first and said second weakened severance lines comprise perforations.

8. The product dispensing system of claim 1 wherein said base wall comprises two of said access doors, and wherein said severance line longitudinally extends between said two access doors.

9. The product dispensing system of claim 1, wherein said priming area comprises a first weakened severance line spanning the width of the base wall and a second weakened severance line spanning the width of the base wall.

10. The product dispensing system of claim 9, wherein said first weakened severance line is spaced apart from and parallel with the second weakened severance line.

11. A product dispensing system comprising:

a container comprising a plurality of walls that define an internal volume, said plurality of walls comprising a base wall, the base wall comprising an access door, a rear edge, a priming area located apart from the rear edge, and a severance line, said priming area being at least partially displaceable relative to said base wall to form a free edge such that said access door is at least partially defined by said free edge and said severance line, said priming area comprising a first weakened severance line spanning the width of the base wall and a second weakened severance line spanning the width of the base wall;

a plurality of products received in said internal volume; and a dispenser comprising:

a frame having a front end and a rear end, said frame comprising a support deck and a product display area, said support deck extending between said front end and said rear end; and an opening tool positioned to sever said severance line as said container is moved along said support deck, wherein said access door pivots relative to said container when said priming area has been displaced and said severance line has been severed so as to release at least one product of said plurality of products from said container to said product display area.

12. The product dispensing system of claim 11, wherein said first weakened severance line is spaced apart from and parallel with the second weakened severance line.

* * * * *